US005809789A

United States Patent [19]

Baker et al.

[11] Patent Number: 5,809,789

[45] Date of Patent: Sep. 22, 1998

[54] REFRIGERATION MODULE

[76] Inventors: Philip L. Baker, 4641 E. Lower Springboro Rd., Waynesville, Ohio 45068; Thomas E. Wrenn, 2818 Sherwood Forest Dr., Miamisburg, Ohio 45439

[21] Appl. No.: 852,582

[22] Filed: May 7, 1997

[51] Int. Cl.[6] ..... F25D 21/06

[52] U.S. Cl. ..... 62/81; 62/156; 62/278

[58] Field of Search ..... 62/80, 81, 151, 62/155, 156, 234, 128, 140, 278, 277

[56] References Cited

U.S. PATENT DOCUMENTS

| | | | |
|---|---|---|---|
| 3,650,122 | 3/1972 | Lieberman | 62/298 |
| 3,664,150 | 5/1972 | Patterson | 62/234 |
| 4,095,435 | 6/1978 | Uemura | 61/84 |
| 4,215,555 | 8/1980 | Cann et al. | 62/324 |
| 4,407,138 | 10/1983 | Mueller | 62/126 |
| 4,457,140 | 7/1984 | Rastelli | 62/261 |
| 4,509,335 | 4/1985 | Griffin et al. | 62/77 |
| 4,907,419 | 3/1990 | Kruck et al. | 62/263 |
| 4,973,387 | 11/1990 | Osterman et al. | 203/39 |
| 5,007,246 | 4/1991 | Kruck | 62/131 |
| 5,009,081 | 4/1991 | Kruck et al. | 62/264 |
| 5,056,327 | 10/1991 | Lammert | 62/151 |
| 5,156,010 | 10/1992 | Inoue et al. | 62/81 |
| 5,182,925 | 2/1993 | Alvarez et al. | 62/347 |
| 5,251,454 | 10/1993 | Yoon | 62/156 |
| 5,319,943 | 6/1994 | Bahel et al. | 62/156 |
| 5,323,621 | 6/1994 | Subera et al. | 62/196.4 |
| 5,339,654 | 8/1994 | Cook et al. | 62/476 |
| 5,345,775 | 9/1994 | Ridenour | 62/140 |
| 5,533,347 | 7/1996 | Ott et al. | 62/115 |
| 5,533,350 | 7/1996 | Gromala et al. | 62/155 |
| 5,546,760 | 8/1996 | Cook et al. | 62/497 |
| 5,575,158 | 11/1996 | Vogel | 62/196.4 |
| 5,689,964 | 11/1997 | Kawakita et al. | 62/151 |

*Primary Examiner*—Harry B. Tanner
*Attorney, Agent, or Firm*—Biebel & French

[57] ABSTRACT

A refrigeration module removably suitable for use in either a refrigerator or a freezer uses signals from a series of temperature sensors for refrigeration control. An automatic defrost cycle is initiated when the evaporator outlet temperature drops to a value equal to the inlet temperature and is accompanied by a constant or rising temperature in the refrigerated cabin to which the module is connected. Field service is limited to an exchange of modules, so that refrigerating gas is not lost into the environment.

3 Claims, 9 Drawing Sheets

REFRIGERATION MODULE

BACKGROUND OF THE INVENTION

This invention relates to a refrigeration module which may be installed in either a refrigerator or a freezer and which may be removed for servicing. Any maintenance operations involving risk of refrigeration gas escape are done at a remote facility having all the necessary equipment for minimizing that risk and thereby safeguarding the environment. It is contemplated that on-site servicing would involve merely the removal of a refrigeration module configured in accordance with this invention and replacement thereof by another unit which has been recycled through the remote facility.

This invention also relates to a computer controlled refrigeration module which is energy efficient and interchangeably usable as either a freezer unit or a refrigerator unit.

SUMMARY OF THE INVENTION

This invention provides a refrigeration module equipped with a set of temperature sensors for measuring critical temperatures within the system. A programmed digital computer processes the temperature measurements for use in controlling a compressor, a condenser fan and an evaporator fan. These mechanical devices are switched on and off at appropriate times for optimal freezing or cooling. Furthermore, when these devices are turned on, they are operated at optimal driving torques, as established empirically and stored in a look-up table programmed into the computer.

It is a feature of the invention that the temperature sensors sense the temperature at the inlet and at the outlet of the evaporator and also the temperature in the chilled cabin. If the system senses no temperature differential across the evaporator concurrently with no decrease in the cabin temperature, then this is taken as an indication of ice on the evaporator. The system reacts by shunting hot refrigerant gas from the compressor directly to the evaporator inlet. This defrosts the evaporator.

It is another feature of the invention that the pressure across the condenser and the pressure across the evaporator are deduced indirectly by measuring the temperatures thereacross. The indirectly determined pressure differences are maintained within desired ranges by turning the condenser and evaporator fans on and off.

Other objects and advantages of the invention will be apparent from the following description, the accompanying drawings and the appended claims.

DETAILED DESCRIPTION OF THE PREFERRED EMBODIMENT

Figure 1:
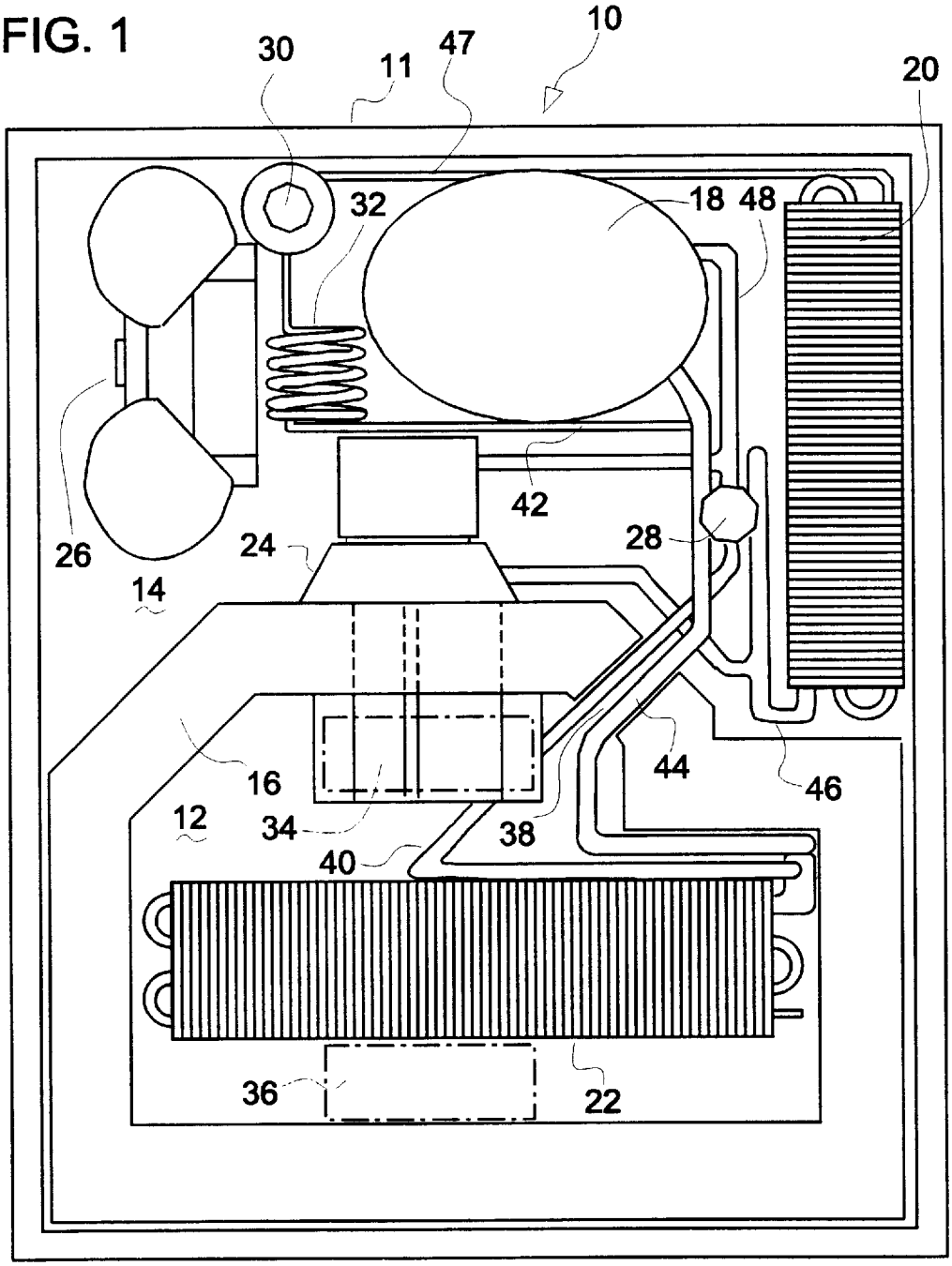
FIG. 1 is a top plan view of the refrigeration module with the cover removed.
Figure 2:
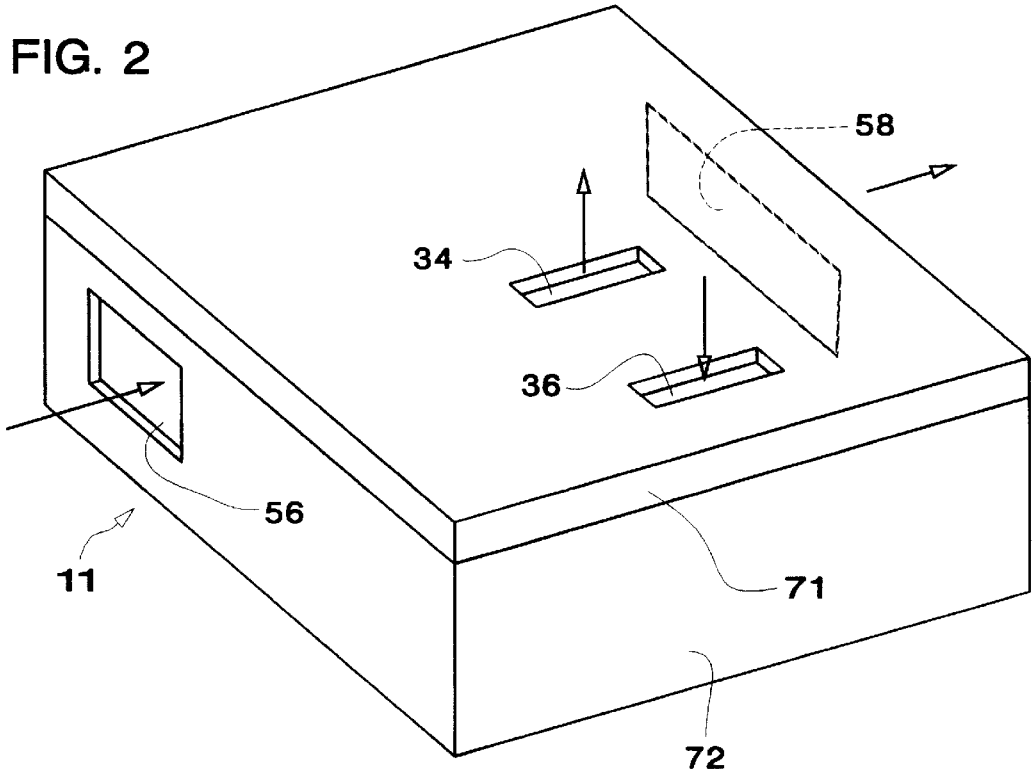
FIG. 2 is a perspective view of a cabinet for the refrigeration module showing air flow openings.

A refrigeration module in accordance with the present invention may appear as generally indicated by the reference numeral 10 of FIG. 1. The refrigeration module 10 may be housed in the cabinet 11 as best illustrated in FIG. 2. Cabinet 11 has a shell 72 and a cover 71. The shell 72 has a pair of openings 56, 58 for circulation of ambient air therethrough. Cover 71 has a pair of openings 34, 36 for respectively circulating cooled air to a refrigerated cabin and receiving a return flow of air therefrom. As illustrated in FIG. 1, cover 71 has been removed from cabinet 11.

Referring still to FIG. 1, cabinet 11 may house a compressor 18, a condenser 20 and an evaporator 22. Evaporator 22 is situated within a cold compartment 12 surrounded by an insulated wall 16. Compressor 18 and condenser 20 are situated within a warm compartment 14 which is that portion of the module outside the insulated wall 16.

A passage 38 within the wall 16 provides access to the cold compartment 12 by refrigerant-carrying conduits. During normal cooling operation there is a build-up of ice within passageway 38, thereby effectively sealing off the space around the conduits extending through the passageway. During a defrosting cycle, as discussed below, hot refrigerating gas in the conduit 40 melts the ice in passageway 38 and also defrosts evaporator 22.

Turning now to cold compartment 12, liquid refrigerant is supplied by a line 42 which is secured to or within another line 44. The line 42 is visible in warm compartment 14 and is seen to pass below a somewhat larger line 44. The line 42 is secured to the lower surface of the line 44 and follows the line 44 into cold compartment 12 and into the inlet side of evaporator 22. The larger line 44 is connected to the outlet from evaporator 22 and carries spent gas back to compressor 18. A fan 24 extends through the wall 16 from the warm compartment 14 to the cold compartment 12 for circulating cold air upwardly through the passageway 34 and into a refrigerated cabin (not illustrated). This creates a pressure drop which draws used cabin air downwardly into passageway 36 and across the heat exchange surfaces of evaporator 22 thereby cooling the air for recirculation back to the cabin (not illustrated) and concomitantly warming the refrigerating gas flowing through evaporator 22. A conventional expansion valve at the evaporator inlet (not illustrated) enables spontaneous conversion of liquid refrigerant into a cold refrigerating gas.

Warm compartment 14 houses a compressor 18 for delivering compressed gas to a line 48 which is connected to the line 40 by a valve 28. Valve 28 is normally closed, so that hot compressed gas in line 48 finds its way to line 46 which is the inlet line for condenser 20. A cooling fan 26 circulates ambient air through warm compartment 14 and across heat exchange surfaces of condenser 20. The hot refrigerating gas condenses into a liquid within condenser 20 and flows through a line 47 to a conventional dryer 30. From dryer 30, the liquid refrigerant flows through a pre-cooler 32 and thence into the previously discussed line 42. When it becomes necessary to defrost the evaporator 22, valve 28 is opened, thereby allowing hot compressed gas to flow into line 40.

Figure 3:
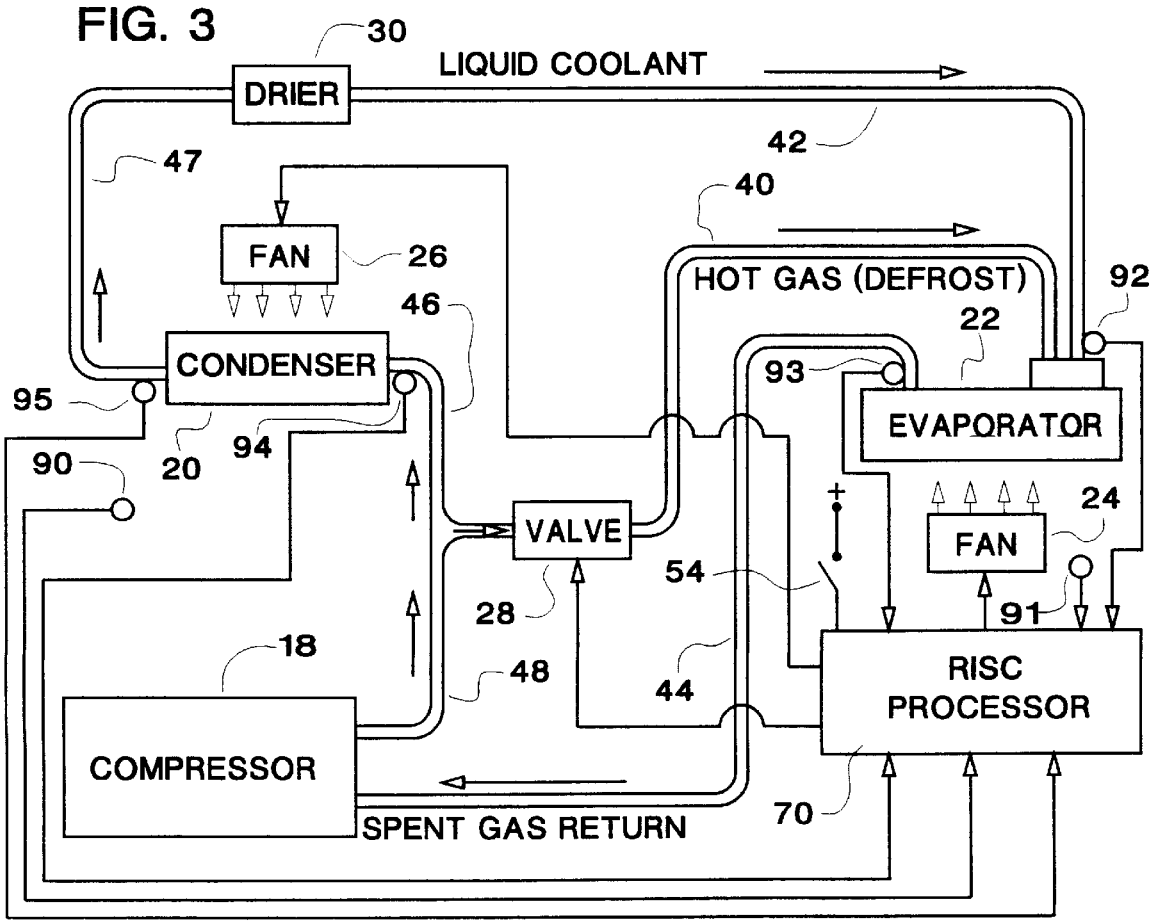
FIG. 3 is a schematic diagram of a control unit for the refrigeration module.

FIG. 3 illustrates the control connections for the equipment shown in FIG. 2. As shown therein, the system is controlled by a RISC processor 70. There is a two position switch 54 which may be toggled to signal RISC processor 70 to operate module 10 as either a refrigerator module or a freezer module. Reference signals for module control are provided by six temperature sensors 90–95.

Sensor 90 measures the ambient air temperature, while sensor 91 measures the temperature of the chilled cabin. Sensors 92, 93 respectively measure the inlet and outlet temperatures of evaporator 22 and sensors 94, 95 respectively measure the inlet and outlet temperatures of condenser 20. In general it is desired to control the pressures at those points. However, the pressure has a known thermodynamic relationship to the temperature. Therefore the pressure is controlled indirectly by controlling the temperature. Optimal temperature relationships are established empirically by operating cooling fans 24, 34 to produce a range of temperature values over a range of ambient conditions. Module power consumption is monitored throughout, so that control temperatures may be established for minimizing power consumption. These temperature values are tabulated and saved for use as control parameters, as discussed below.

The empirical process which establishes control temperatures also establishes optimal driving torques for fans 24, 34 and compressor 18. Driving torque is controlled by RISC processor 70 in a conventional manner by using a zero crossing detector to monitor line voltage and thereby establish a phase reference. The motors for the fans and the compressor are driven by a triac which is triggered in phased relationship with the line current to produce a desired driving torque.

While RISC processor 70 is illustrated by a single block in FIG. 3, the preferred embodiment incorporates three different RISC processors in that single block. A first processor converts the temperature sensing signals from analog to digital form, while a second exercises overall supervisory control. The third processor receives motor control commands from the second processor and generates correctly phased motor driving signals.

Efficient operation of module 10 requires that evaporator 22 be periodically defrosted so as to remove accumulated ice. In general the prior art performs defrosting at regularly timed, predetermined intervals. In contrast thereto the refrigeration module of this invention defrosts only as needed. The need is established by monitoring the evaporator inlet and outlet temperatures from sensors 92, 93 and the cabin temperature from sensor 91. It has been found that when an ice layer forms on the evaporator's heat exchange surface, the evaporator output temperature drops to a value equal to the input temperature, and cabin refrigeration is lost, as indicated by a constant or rising cabin temperature. RISC processor 70 responds to this condition by opening valve 28 and admitting hot, compressed refrigerating gas directly into the evaporator inlet.

The details of the refrigeration control logic are presented in the flow chart of FIGS. 4A–4F. The control scheme shown therein requires establishment of values for 9 control parameters P1–P9. A first set of 9 values is established empirically for freezer operation, and a second set of 9 values is established empirically for refrigerator operation. These eighteen values are stored in RISC processor 70, and a set selection is made in accordance with the setting of switch 54.

While the values for the above parameter sets are heavily dependant upon the details of system implementation, a typical set of values may be in the order of those set forth below in Table I.

TABLE I

| Parameter | Freezer Value | Refrigerator Value |
|---|---|---|
| P1 | 30 seconds | 120 seconds |
| P2 | 10° F. | 10° F. |
| P3 | −3° F. | −3° F. |

TABLE I-continued

| Parameter | Freezer Value | Refrigerator Value |
|---|---|---|
| P4 | 25° F. | 42° F. |
| P5 | 0° F. | 42° F. |
| P6 | −5° F. | 36° F. |
| P7 | 0 sec | 0 sec |
| P8 | 60° F. | 60° F. |
| P9 | 60° F. | 60° F. |

Figure 4A:
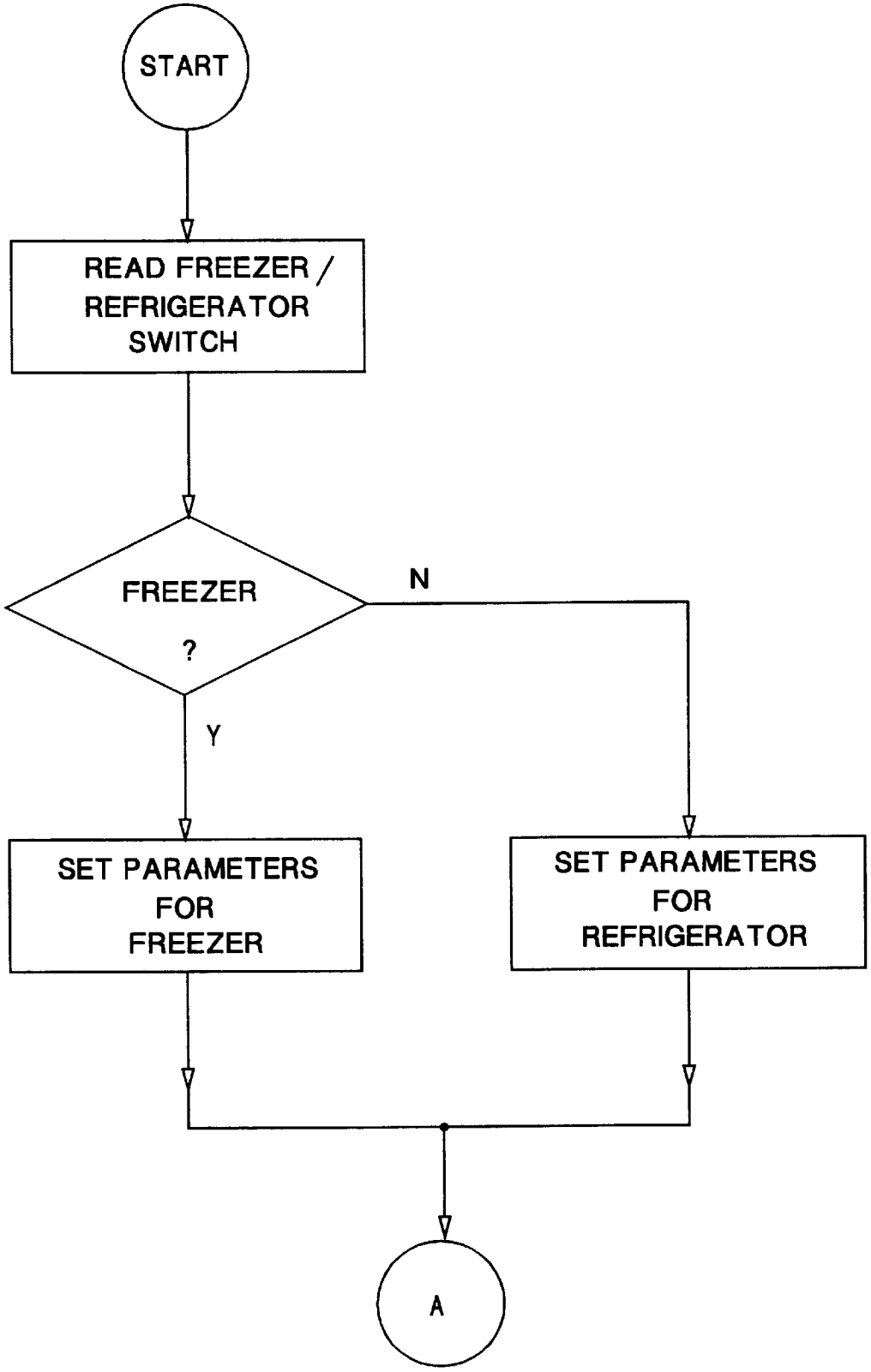
FIGS. 4A–4F are a flow chart for a computer program implemented within the refrigeration module.

Now referring to FIG. 4A, the control sequence commences with a reading of the position of the freezer refrigerator switch 54. If the switch is found to be in the freezer position, then the values listed in the first column of Table I are stored in active memory as control parameters. This causes the module to behave as a freezing unit. If, on the other hand, switch 54 is found to be in the refrigerator position, then the tabulated values from the second column of Table I are loaded into active memory, thereby configuring refrigeration module 10 as a refrigerating module.

Figure 4B:
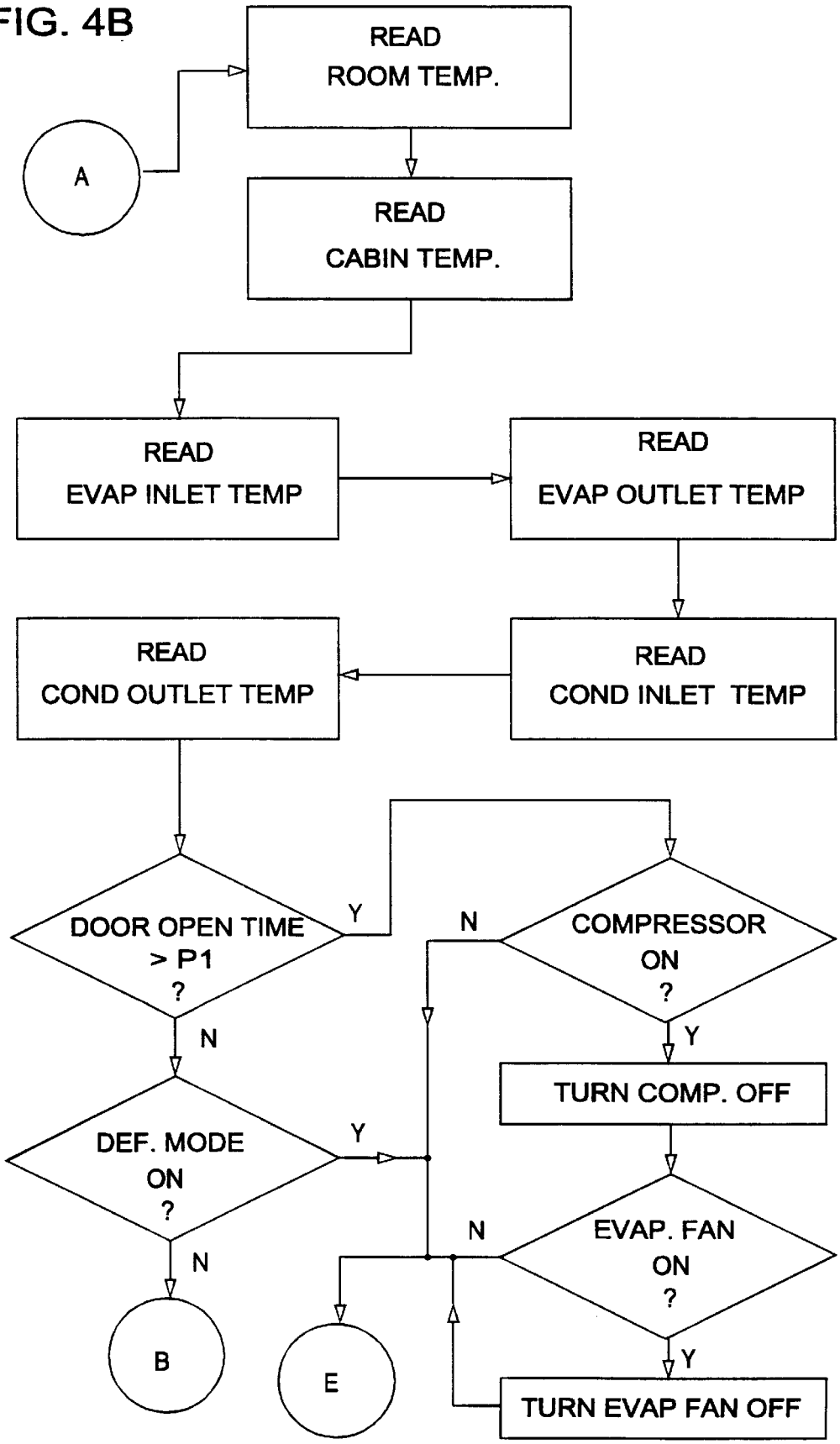

After values have been established for the parameters P1–P9, the system branches to branch point A and continues with the sequence on FIG. 4B. It should be noted that branch point A functions as a return point for the remainder of the control sequence. That is, the system passes once through the logic steps outlined in FIG. 4A and then loops continuously back through branch point A.

Each time the program reaches branch point A, it reads the temperatures being reported by temperature sensors 90–95. Thus the current room temperature, cabin temperature, evaporator inlet temperature, evaporator outlet temperature, condenser inlet temperature and condenser outlet temperature are read and stored in active memory. Thereafter, as illustrated in FIG. 4B, the system reads the value of a timer (not illustrated) which is set to a value of 0 whenever the cabin door is opened. The timer value is compared with the parameter P1 which is a door open limit time. If the door is found to have been opened for more than some predetermined period of time as established by the parameter P1, then the compressor and evaporator are turned off, and the system branches to point E which leads to further logic determining whether or not a defrost cycle should be initiated.

If the door has been opened for more than the time established by parameter P1, then the system checks to see whether it is currently in a defrost cycle. If not, there is a branch to point B which will lead to normal cooling operation.

Figure 4C:
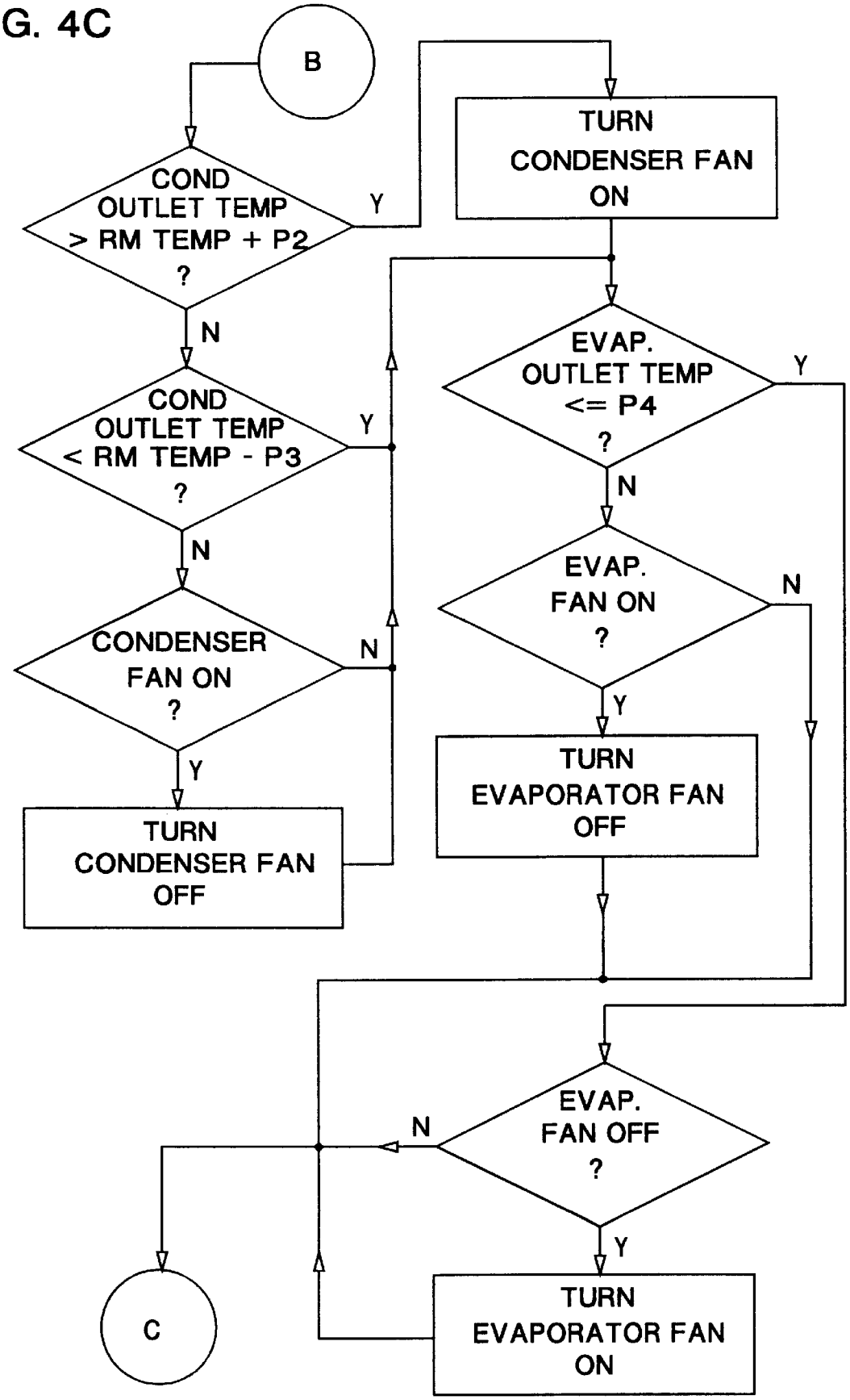

Upon reaching branch point B, the system proceeds with the logic illustrated on FIG. 4C. This involves checking the outlet temperature of the condenser to determine whether it is within a temperature range between room temperature plus P2 and room temperature minus P3. If the condenser temperature is above that range, then the condenser fan is turned on. If the condenser temperature is below that range, then the fan is turned off. Within that range no change is made in the operation of the condenser fan.

After checking the condition of the condenser, the system compares the evaporator outlet temperature with the parameter P4. If the temperature is not greater than P4, then the evaporator fan is turned off. After the system has checked the conditions of the condenser and the evaporator, it branches to branch point C which continues on FIG. 4D.

Figure 4D:
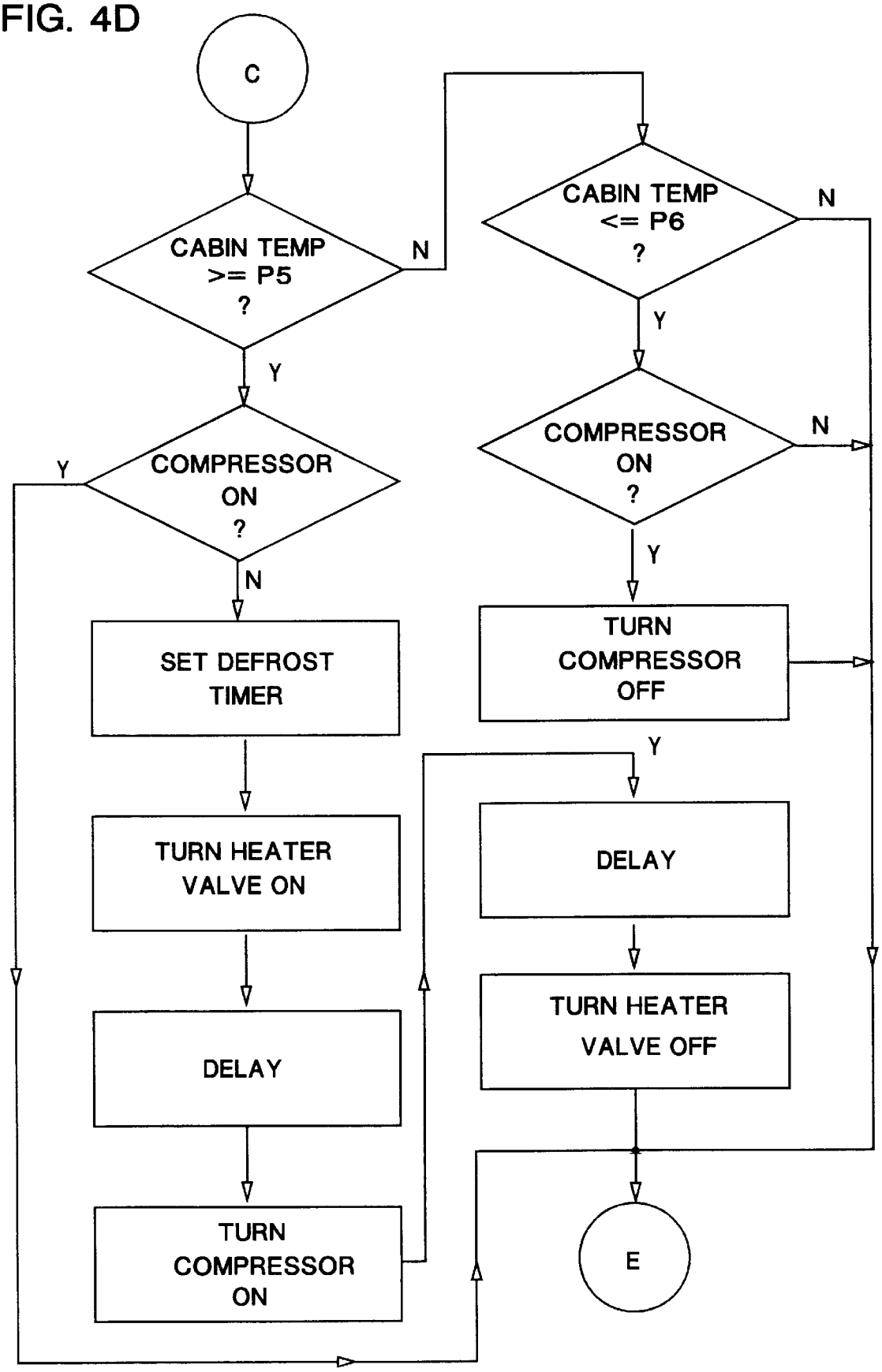

Referring now to FIG. 4D, the checks of the condenser and evaporator are followed by comparison of the cabin temperature with the parameters P5 and P6. If the cabin temperature is found to be in a range between P5 and P6, then the program branches to point E for further activity as will be discussed below. In that case there is no immediate change to the state of the compressor. If the cabin temperature is below P6, and the compressor happens to be turned on, then the compressor is turned off. That is done, because the cabin is already cooler than desired, and there is no need for the compressor to operate.

If the cabin temperature is above P5, the system checks to determine whether the compressor is on. If the compressor happens to be off, then the defrost timer is set, and the heater valve is turned on for a short period of time. The compressor is turned on at a point in time while the heater valve is on and continues operating after the heater valve is turned off. This conserves energy and prolongs the life of the compressor by ensuring that it does not start with a full head of pressure. Thereafter the system branches to point E on FIG. 4E.

Having passed through branch point E, the system checks the time on the defrost timer to determine whether the time has decreased to a value P7, which may be 0. If so, then the system proceeds to check for ice on the evaporator. If not, there is a return to branch point A. If the compressor is on and sufficient time has elapsed since the setting of the defrost timer, then the system checks to determine whether the defrost mode has been activated. If so, it branches through point F to the sequence shown on FIG. 4F. If the defrost mode has not been activated, then the system checks to find out whether a defrost is required. This check is made by determining whether the outlet temperature of the evaporator is greater than the inlet temperature. During normal, frost-free operation of the system the evaporator outlet temperature will be greater than the inlet temperature, and the system will simply return to branch point A.

Figure 4E:
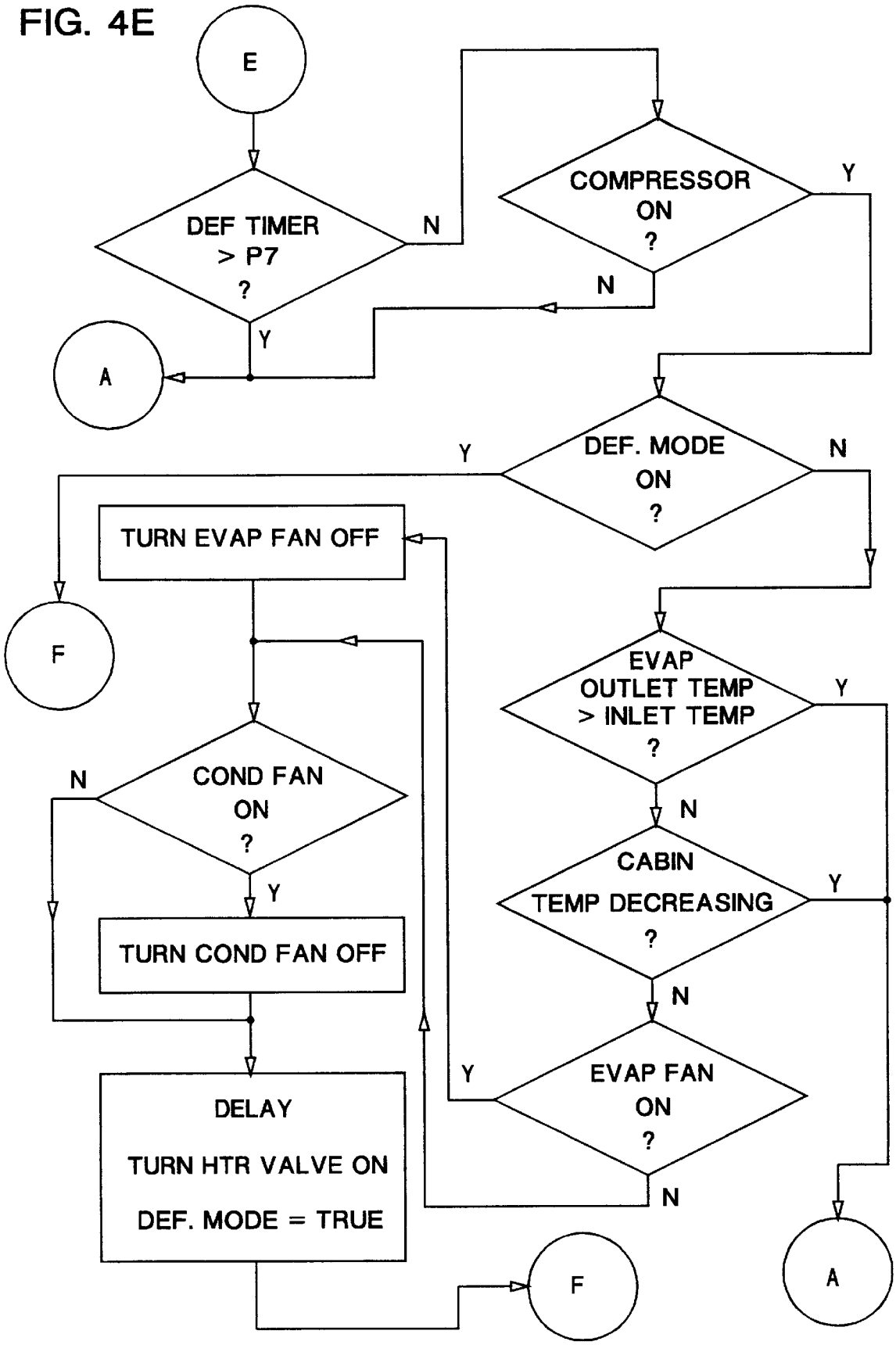
Figure 4F:
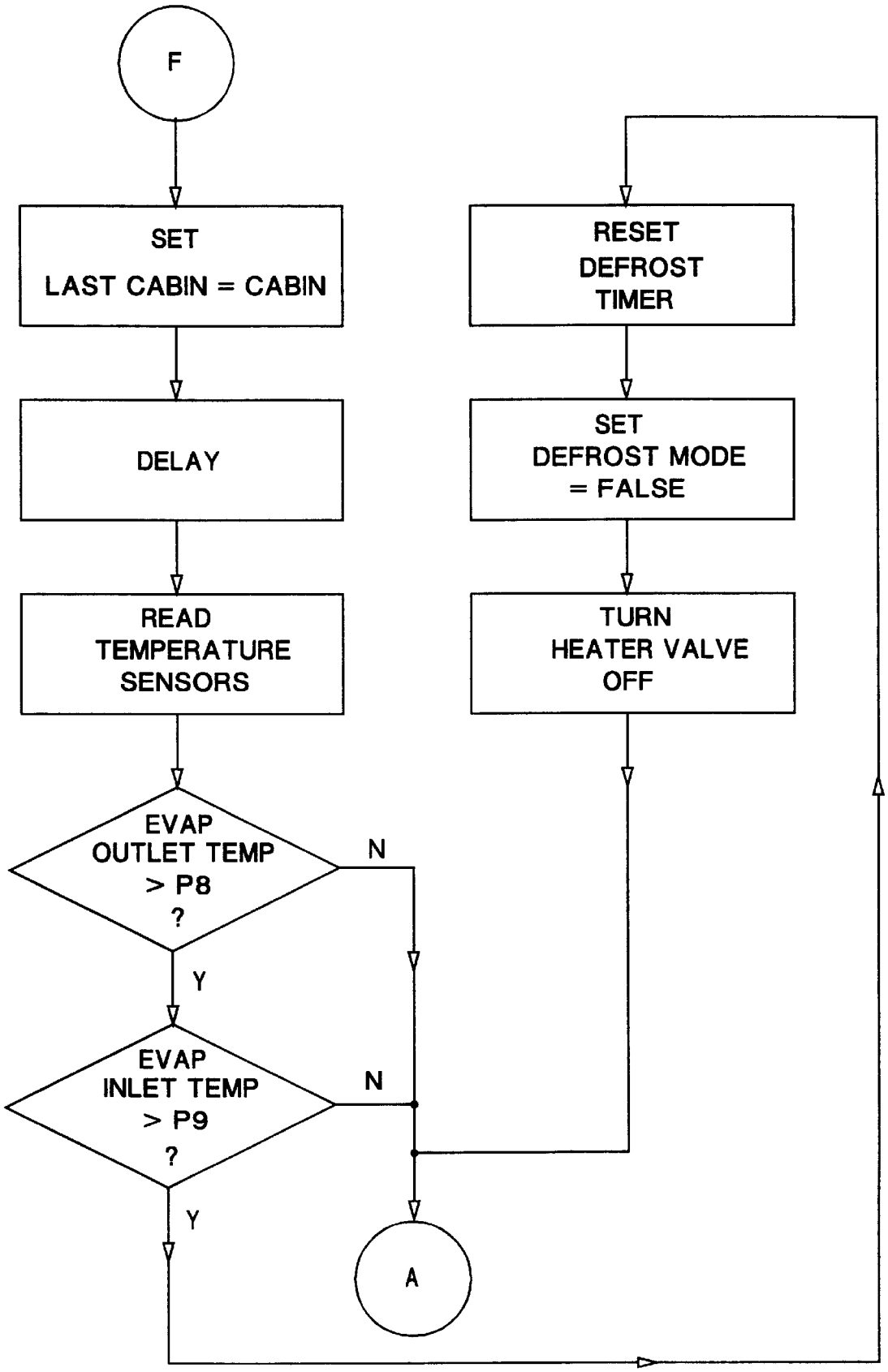

Following each pass through the logic of FIG. 4E, the system passes through branch point F to the logic of FIG. 4F. Turning briefly to FIG. 4F, it will be seen that a variable named "LAST CABIN" is set to a value equal to the current cabin temperature. Following the setting of "LAST CABIN" a new temperature value is read from sensor 91. At the conclusion of the steps illustrated in FIG. 4F the system returns to branch point E. This means that when the system is performing the frost check illustrated in FIG. 4E, it knows a present value of the cabin temperature and also a previous value. Therefore it may be determined whether or not the cabin temperature is decreasing. Returning again to FIG. 4E, if the evaporator outlet temperature is not greater than the inlet temperature, and the cabin temperature is either constant or increasing, the system concludes that a defrost cycle is required. The indicated defrost cycle is commenced by turning off the evaporator fan and the condenser fan, waiting a predetermined period of time which may be in the order of about 15 seconds, and then turning the heater valve on. Finally a variable named "defrost mode" is set equal to TRUE, and the system passes through branch point F to the logic of FIG. 4F.

Referring to FIG. 4F the system assigns a value to LAST CABIN, as described above, delays about 2 seconds, and then reads all of the temperature sensors, including the cabin temperature sensor 91. The heater valve remains open, and the defrosting continues while the system monitors the evaporator inlet and outlet temperatures. When the outlet temperature has exceeded P8 and the inlet temperature has exceeded P9, the defrost timer is reset, the defrost mode is terminated, and the heater valve is closed.

As described above, evaporator coil icing may be established by a two prong test involving evaporator inlet temperature, evaporator outlet temperature and cabin temperature. As disclosed in FIG. 4E the first prong is satisfied when the outlet temperature fails to exceed the inlet temperature. Viewed somewhat more generally, the outlet temperature need not necessarily drop to a temperature equal to or less than the inlet temperature. It is sufficient that the outlet temperature be greater than the inlet temperature by an amount less than some predetermined minimum. That minimum, of course, may have a value of 0.

Figure 5:
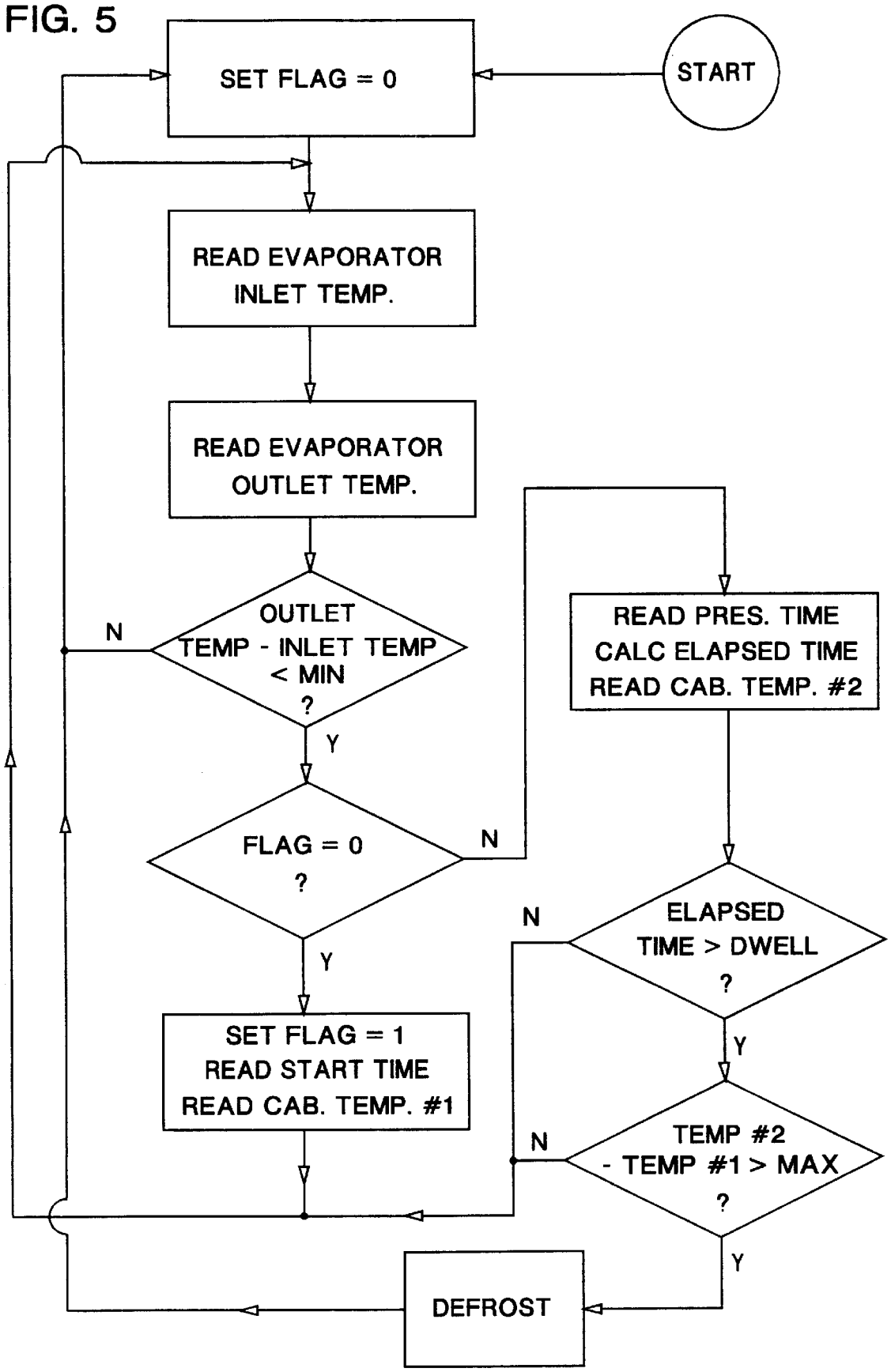
FIG. 5 is a flow chart showing defrosting control in an alternative embodiment.

FIG. 5 presents an alternative embodiment of the invention wherein the difference between the outlet temperature and the inlet temperature is compared against a minimum difference value. When the minimum difference is not present, then the system in the alternative embodiment reads the cabin temperature and sets a timer. The timer is permitted to run so long as the prescribed temperature conditions at the evaporator subsist. If the temperature conditions at the evaporator continue for a predetermined dwell time, then the present cabin temperature is compared against the cabin temperature reading which had been obtained at the time when the timer was set. If the present temperature exceeds the reference temperature by more than a predetermined maximum, then a defrost cycle is initiated.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A self-contained refrigeration module comprising:

(a) A cabinet provided with a cold air outlet port, a cold air return port, an ambient air supply port and an ambient air discharge port;

(b) Insulative wall means defining a cold compartment within said cabinet, said cold compartment being in communication with said cold air outlet port and with said cold air return port and being isolated from said ambient air supply port and from said ambient air discharge port;

(c) Fan means mounted inside said cabinet for causing a flow of ambient air along a first path from said ambient air supply port to said ambient air discharge port and a flow of cold air along a second path from said cold air return port to said cold air outlet port;

(d) A compressor mounted inside said cabinet and outside said cold compartment for compressing a refrigerating gas;

(e) A condenser mounted inside said cabinet across said first path for receiving compressed refrigerating gas from said compressor and condensing said compressed refrigerating gas into a refrigerating liquid;

(f) An evaporator mounted inside said cold compartment across said second path, for receiving refrigerating liquid from said condenser and vaporizing said refrigerating liquid to produce a cold refrigerating gas, said evaporator being provided with heat transfer surfaces for transferring heat from said cold air to said cold refrigerating gas thereby generating a spent refrigerating gas for return to said compressor;

(g) A first temperature sensor for generating a first temperature signal corresponding to the temperature of said cold refrigerating gas;

(h) A second temperature sensor for generating a second temperature signal corresponding to the temperature of said spent refrigerating gas;

(i) A third temperature sensor for generating a third temperature signal corresponding to the temperature of said second flow of air at said cold air return port;

(j) A heater valve for defrosting said evaporator by selectively directing compressed refrigerating gas thereto; and (k) Computing means for controlling said heater valve to direct said compressed refrigerating gas to said evaporator when said first and second temperature signals differ from each other by less than a predetermined minimum amount, and said third temperature signal increases more than a predetermined maximum amount in a predetermined time.

2. A method of defrosting an evaporator having a cold refrigerating gas flowing therethrough and positioned within a stream of cold, flowing air for transferring heat from said air into said gas, said method comprising the steps of:

(1) Measuring a spatial change in a temperature of said gas at different locations within said evaporator;

(2) Measuring a temporal change in a temperature of said air at a fixed location within said stream; and (3) Supplying hot refrigerating gas to said evaporator when said spatial change is less than a predetermined amount and said temporal change is not negative.

3. A method according to claim 2 further comprising the step of terminating said supplying when temperatures greater than predetermined amounts are measured at said different locations.

* * * * *